US007951047B2

(12) United States Patent
Köhler

(10) Patent No.: US 7,951,047 B2
(45) Date of Patent: May 31, 2011

(54) ROPE GAME DEVICE

(75) Inventor: Karl-Heinz Köhler, Berlin (DE)

(73) Assignee: Berliner Seilfabrik & Co. KG, Berlin (DE)

( * ) Notice: Subject to any disclaimer, the term of this patent is extended or adjusted under 35 U.S.C. 154(b) by 765 days.

(21) Appl. No.: 10/572,605

(22) PCT Filed: Sep. 14, 2005

(86) PCT No.: PCT/EP2005/010067

§ 371 (c)(1),
(2), (4) Date: Jun. 15, 2007

(87) PCT Pub. No.: WO2006/029900

PCT Pub. Date: Mar. 23, 2006

(65) Prior Publication Data

US 2007/0275828 A1 Nov. 29, 2007

(30) Foreign Application Priority Data

Sep. 14, 2004 (DE) ..... 10 2004 045 543
Sep. 14, 2004 (DE) ..... 20 2004 016 036 U
Jul. 28, 2005 (DE) ..... 20 2005 012 211 U

(51) Int. Cl.
*A66B 21/00* (2006.01)

(52) U.S. Cl. ..... 482/23; 482/35; 482/33; 482/34; 482/37; 482/36

(58) Field of Classification Search ..... 482/23, 482/35, 33, 34, 36, 37
See application file for complete search history.

(56) References Cited

U.S. PATENT DOCUMENTS 3,970,301 A * 7/1976 Lehmann ..... 482/35
4,084,812 A * 4/1978 Melrose et al. ..... 472/118
4,097,043 A * 6/1978 Rudy ..... 482/35
7,052,437 B2 * 5/2006 Kohler ..... 482/51

FOREIGN PATENT DOCUMENTS

DE 20 64 791 A1 6/1972
DE 101 36 643 A1 2/2003
WO WO 02/074392 9/2002

* cited by examiner

*Primary Examiner* — Jerome W Donnelly
(74) *Attorney, Agent, or Firm* — Norris, McLaughlin & Marcus, P.A.

(57) ABSTRACT

The invention relates to a rope game device with an outer frame and with ropes rigged within the outer frame forming a spatial net and which are attached in a tensionable manner to specific node points of the outer frame.
The invention has the object, to provide a new rope game device, which displays a distinct "fullness" of the spatial net and which manufacture has distinct technological and cost advantages compared to known devices.
The object is solved by a rope game device, having an outer frame (1) and ropes, within the outer frame (1) and forming a spatial net (12) and which are attached in a tensionable manner to specific node points (2) of the outer frame (1), characterized in that the outer frame (1) has an icosahedron shape and the edges and the corners of the icosahedron shape are formed as frame elements (4) having the form of an equilaterial triangle comprising rods (3) and the node points (2), and that one or more hollow ball modules (11, 12), arranged within one another and having the spatial form of a truncated icosahedron, are arranged within the outer frame (1) and retained on the same in a tensionable manner.

17 Claims, 7 Drawing Sheets

ROPE GAME DEVICE

Figure 1:
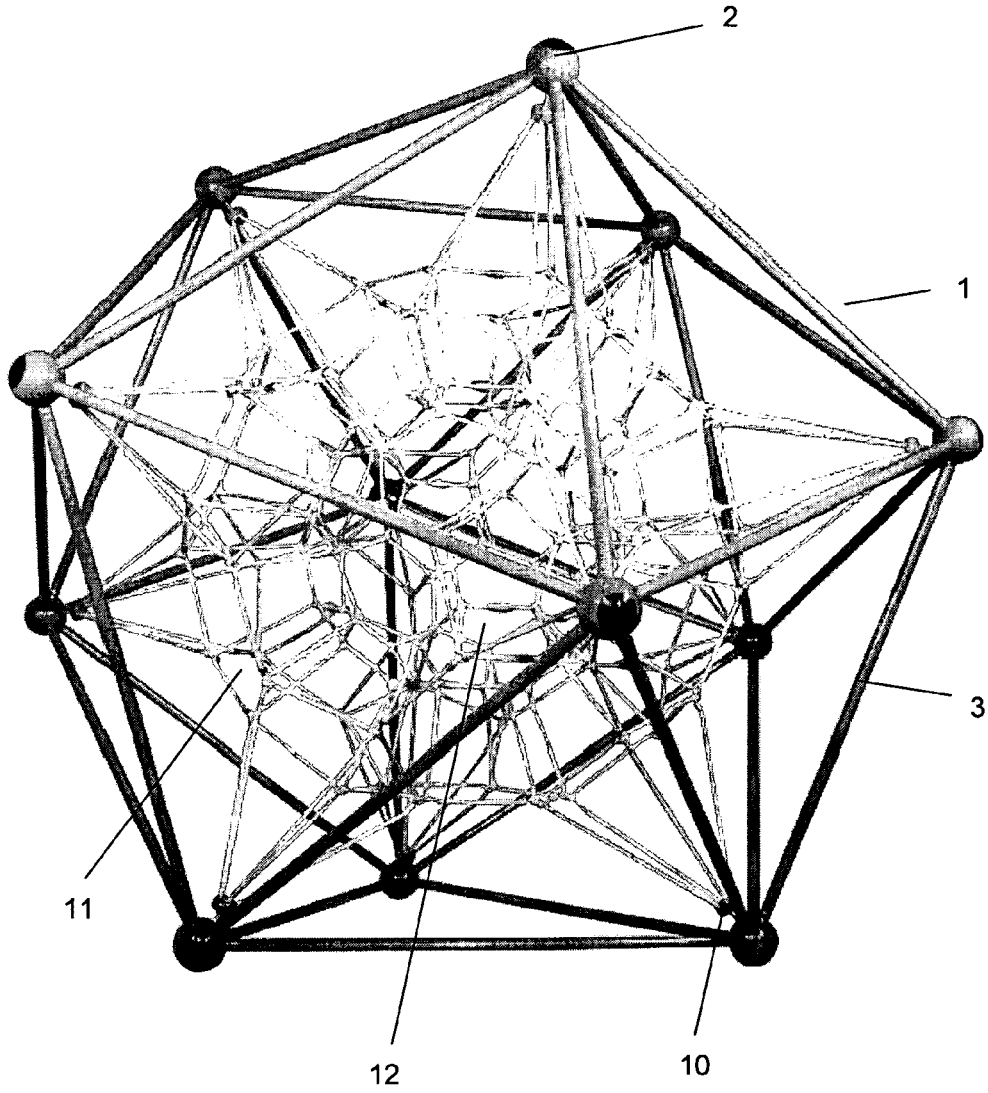

The invention relates to a rope game device with an outer frame and ropes arranged within the outer frame and forming a spatial net and which are attached in a tensionable manner to defined node points of the outer frame.

Rope game devices are known. They are erected on children's play areas as well as on sport- and leisure facilities for climbing, working one's way along with one's hands and swinging. Climbing frames for children with a support frame defining the outer contour of the frame and a spatial rope net rigged therein, are known for example from DE-A 2046791. Between the node points of the support frame, formed as a cuboid or a octahedron, ropes are rigged as connecting element. In this case, also compression rods of the support frame can be partially omitted and can be substituted by an inner compression rod in the spatial rope net. The spatial net is, then, as a whole elastic and it can swing. The there described frame shape on the basis of a square is, as a single game device, however, not very attractive, as on the one hand no distinct spatial net volume is achieved and on the other hand the device can not be combined by a modular construction to larger units, so that besides a multiplication of the individual device no effect concerning the design of attractive spatial shapes can be achieved. In larger game devices, therefore, support frames are used according to the type of a polyhedron, in which internal space an individual, larger rope net is rigged in a stretched manner.

In WO 02074392 A2 a rope game device is described, which has a support frame, which consists of pentagon frame elements, wherein within each frame element a separate rope net is rigged. For connecting the frame elements as well for the anchoring of individual ropes, the already known hollow ball connectors are used. This pentagon-like game devices, which refer back to the dodecahedron-series, have the disadvantage, that a larger number of rope elements and frame elements of different lengths are used, which make the manufacture of these devices technologically complex and costly.

Furthermore, this rope game device is missing a specific "fullness" of the inner structure of the spatial net.

The invention is based on the object, to provide a new rope game device, which is characterised by a particular "fullness" of the spatial net and which manufacture has distinctive technological as well as cost advantages compared to the known devices.

The object is solved by the features of claim 1. Thus, the rope game device with outer frame is characterised in that the outer frame has an icosahedron shape, consisting of frame elements forming equilateral triangles and which triangle tips are connected at the node points to each other and that the inner structure of the spatial net has one or more football-like hollow ball modules arranged within one another and which are retained by guy ropes at the node points of the outer frame.

Advantageous improvements are stated in the dependent claims.

The advantages of the rope game device according to the invention are as follows:

- node points are used, which have all the same shape, for example a spherical node shape. Therefore, the manufacturing process (metal casting) of the node points formed generally as aluminium bodies is especially effective
- the outer frame is composed of rods of the same length
- the volume within the outer frame is used especially effective
- in the installation of a hollow ball module only two rope elements of different lengths are used for the manufacture of the spatial net structure, so that these nets can be assembled by the final user or by local users, respectively, themselves, which is reducing the costs. If further hollow ball modules are arranged within one another, the guy ropes have to be extended by connecting ropes accordingly. Additionally, for each further ball module only 12 shorter pentagon ropes are necessary.

In an embodiment of the invention one outer hollow ball module is retained in a tensionable manner by means of guy ropes at twelve node points of the icosahedron shape.

A further embodiment provides, that an inner hollow ball module is retained by connecting ropes at the outer hollow ball module.

A further embodiment provides, that the outer frame has thirty rods of equal length, which ends are connected to the node points.

In a further embodiment the outer frame has further stabilising elements.

In an improvement the ball modules have twelve regular pentagons and twenty regular hexagons.

A further embodiment provides, that, starting from the corners of each pentagon of the outer hollow ball module, respectively, five guy ropes are brought together in a pyramid manner at the node point and are retained there in a tensionable manner.

In a further embodiment the corners of each pentagon of the outer hollow ball module are, respectively, connected to five connecting ropes to the corners of each pentagon of one or more inner hollow ball modules.

In a further embodiment one hollow ball module is composed of two rope elements of different lengths and which are shorter concerning the inner hollow ball modules.

A further embodiment provides, that the connecting ropes are extended guy ropes.

A further embodiment is characterised in that the twelve node points, connected to each other by rods, are formed as hollow bodies, comprising the rope tensioning elements.

A further embodiment is characterised in that the rods are retained by threaded bolts on a wall of the hollow body.

A further embodiment provides, that the rope tensioning elements are retained in or at the wall of the hollow body, respectively.

The hollow ball modules, achieved by shortening of an icosahedron structure, consisting of twelve pentagons and twenty hexagons, have the form and structure of a football. In contrast to the known spatial rope net modules based on an octahedron, which can be piled on top of each other, and thus, a spatial fullness is achieved, in this case the football-like hollow ball modules are arranged within one another. As in the icosahedron structures all corners are identical and, thus, also the guy points can be formed identically, the spatial nets contain repeatedly occurring identical rope elements, like guy ropes and connecting ropes.

A small hollow ball module is formed only from two differently long guy ropes or connecting ropes, respectively:

The guy rope, extending from tensioning point to tensioning point and simultaneously forms the edges of the hexagon (thirty pieces), and the connecting rope, forming the pentagon (twelve pieces).

If in a larger device a further small hollow ball module should be arranged in the first larger hollow ball module, one only needs 12 times a further smaller pentagon rope position, while the guy ropes are additionally extended, to anchor the inner hollow ball module and to form the edges of the hexagon of the inner spatial ball net.

The invention is explained in detail by means of the drawings and an exemplary description.

It shows

Figure 2:
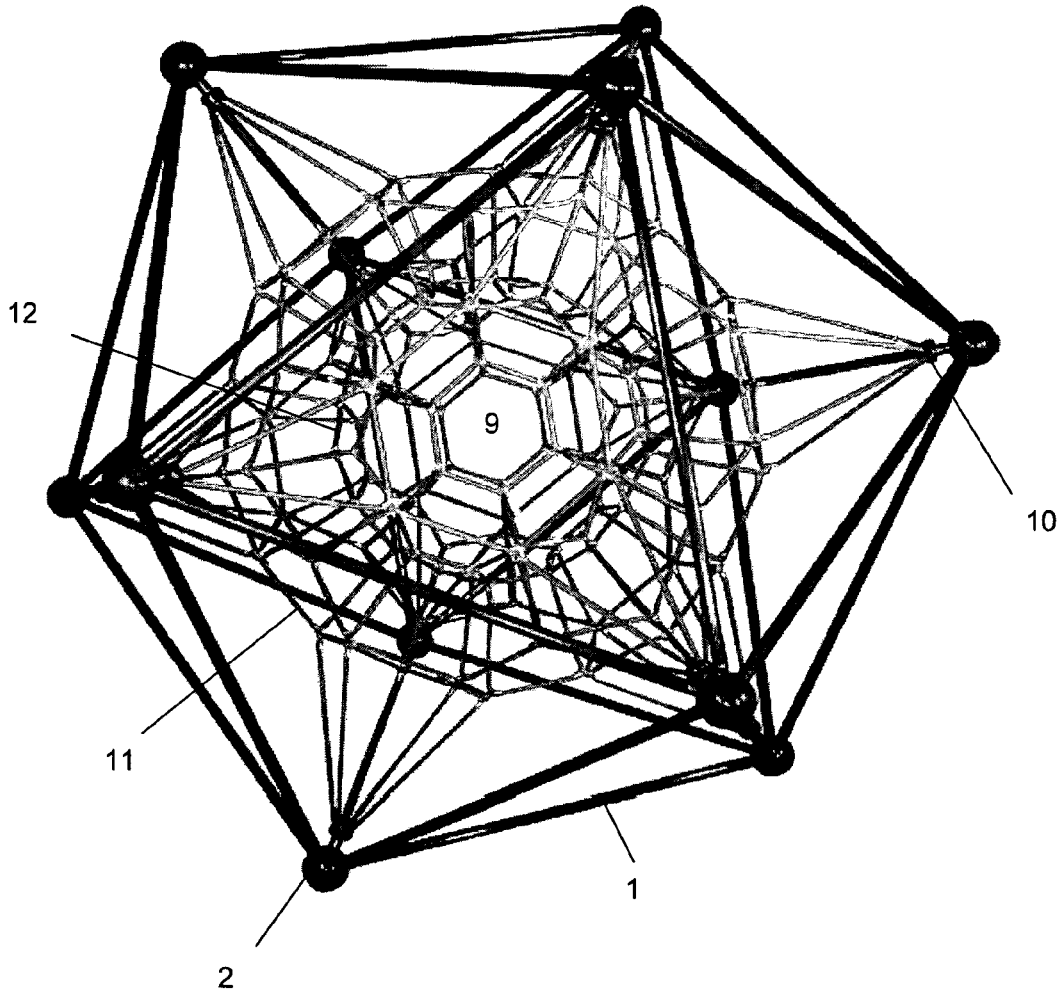
Figure 3:
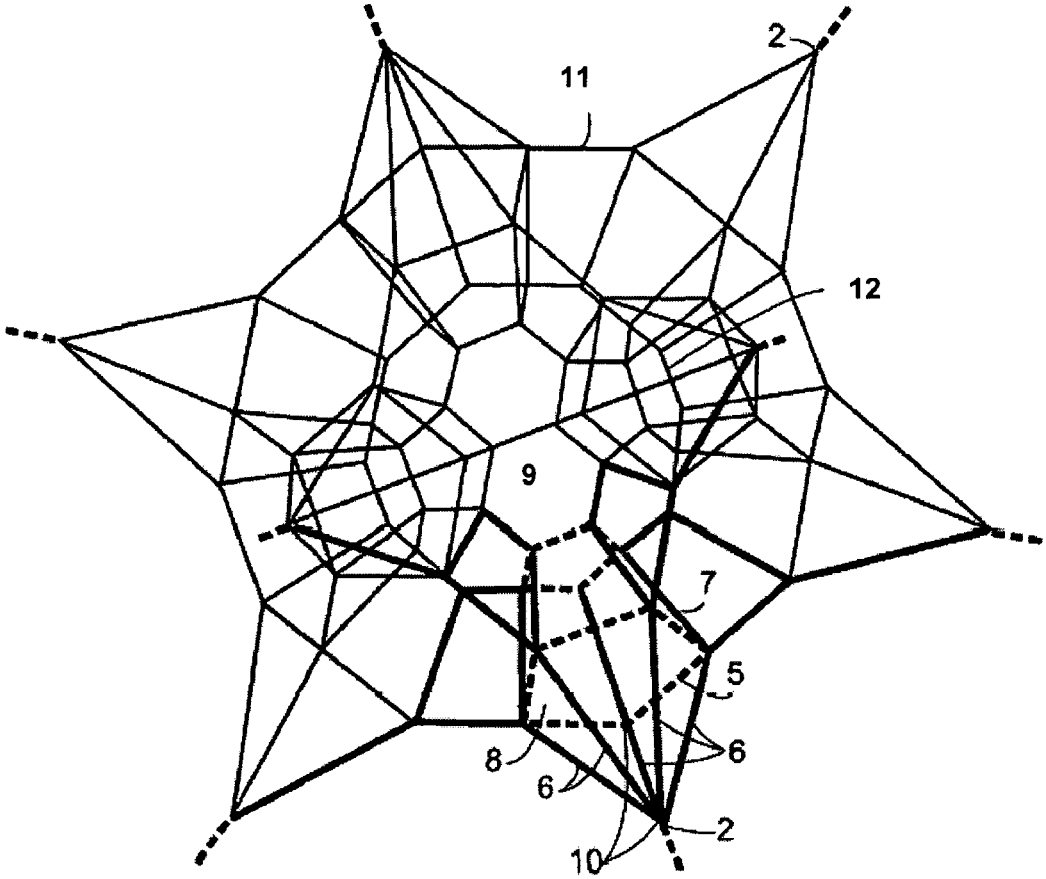
Figure 4:
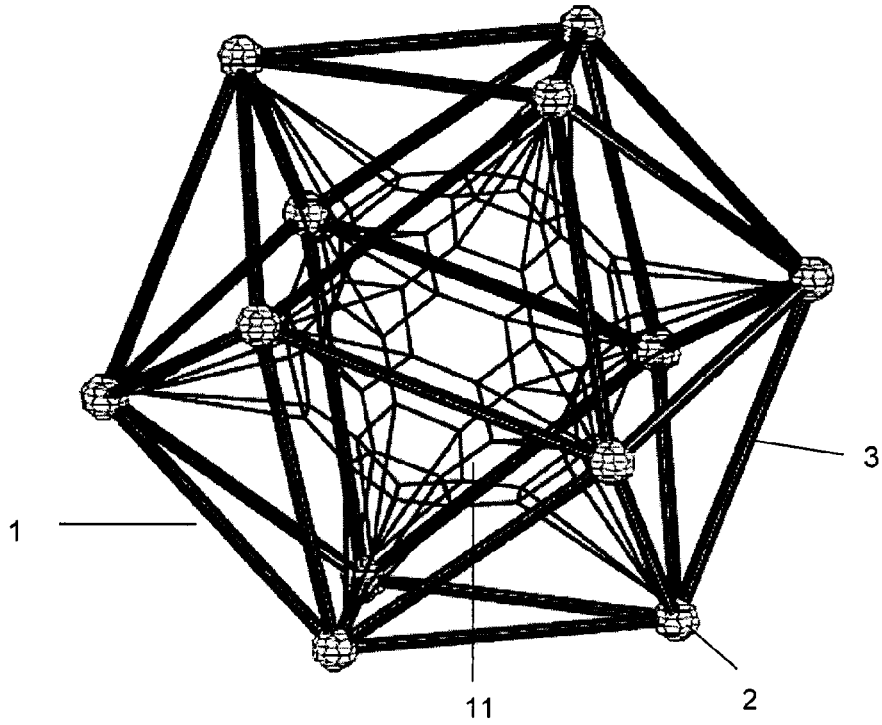
Figure 5:
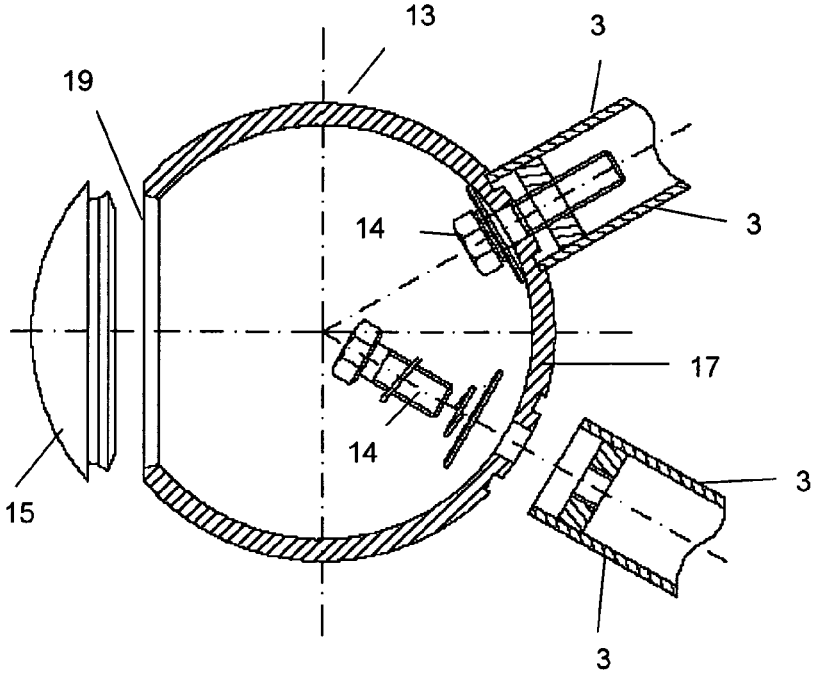
Figure 6:
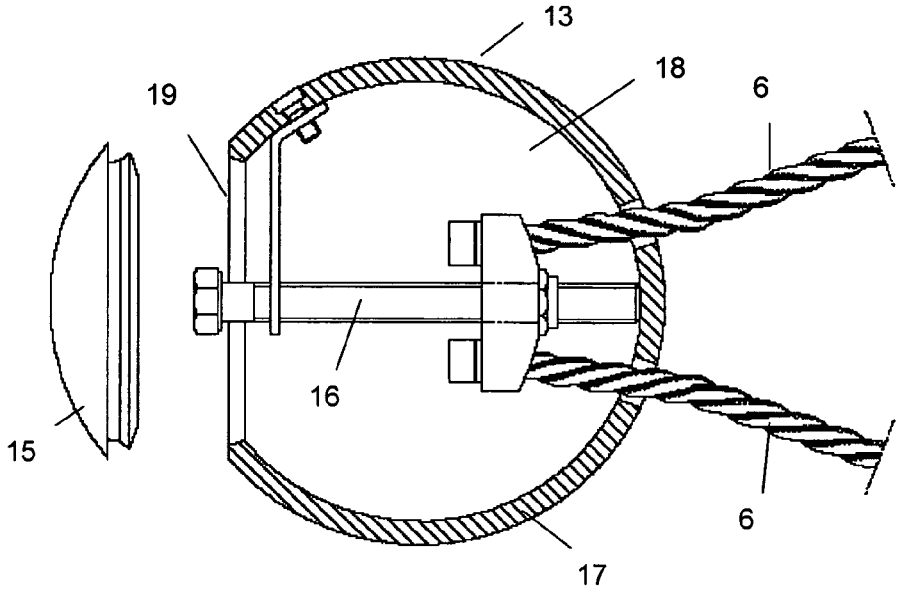
Figure 7:
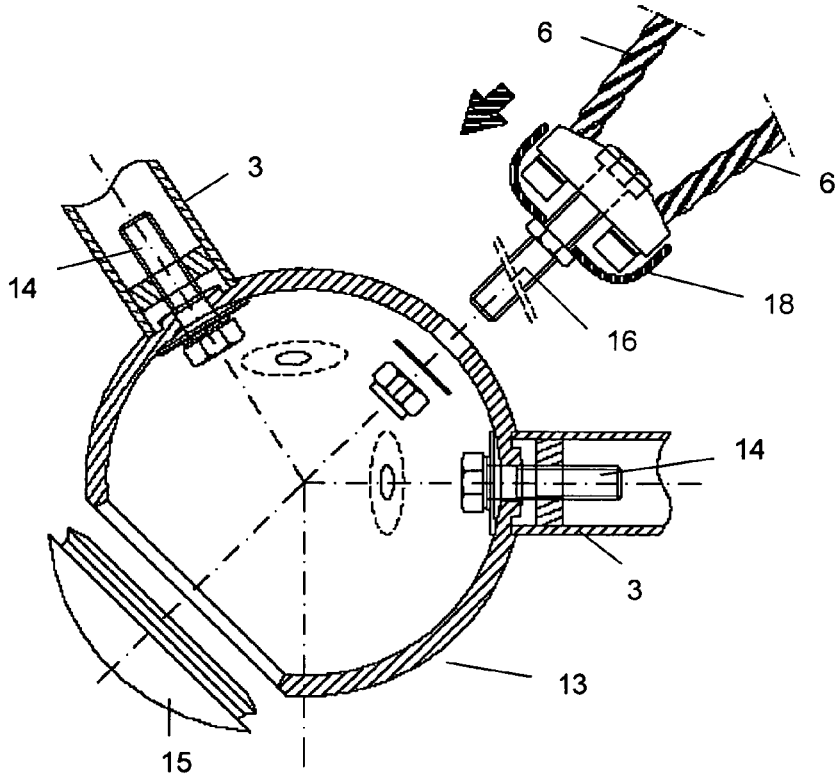
Figure 8:
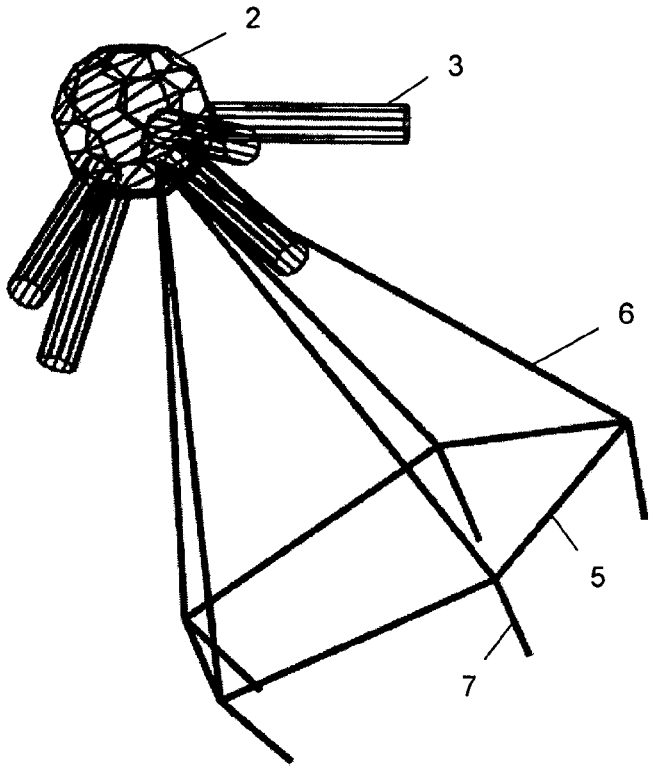
Figure 9:
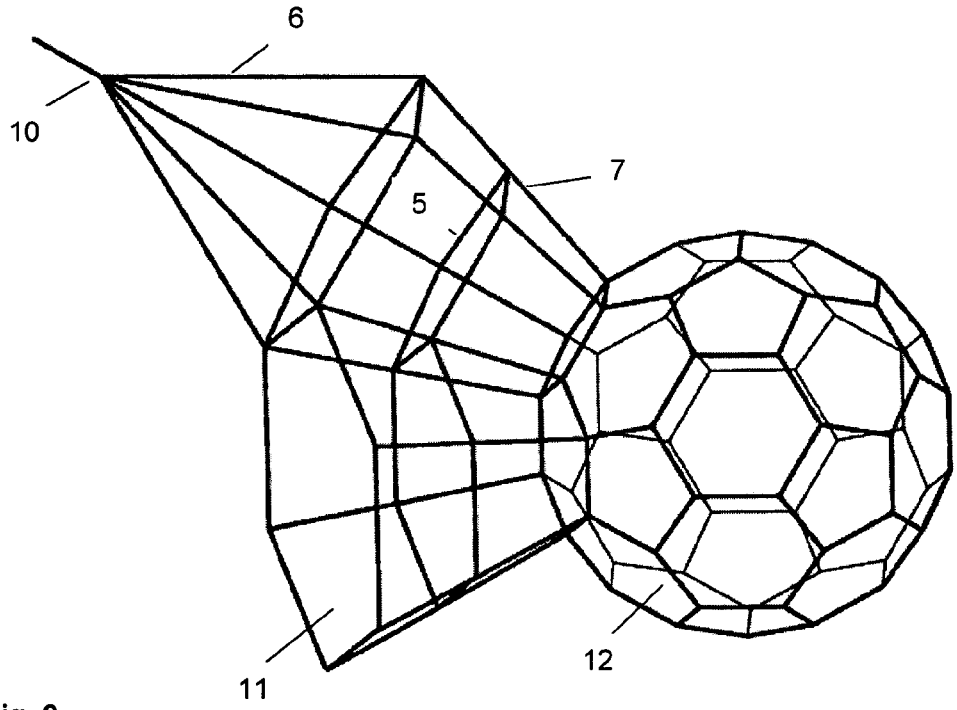
Figure 10:
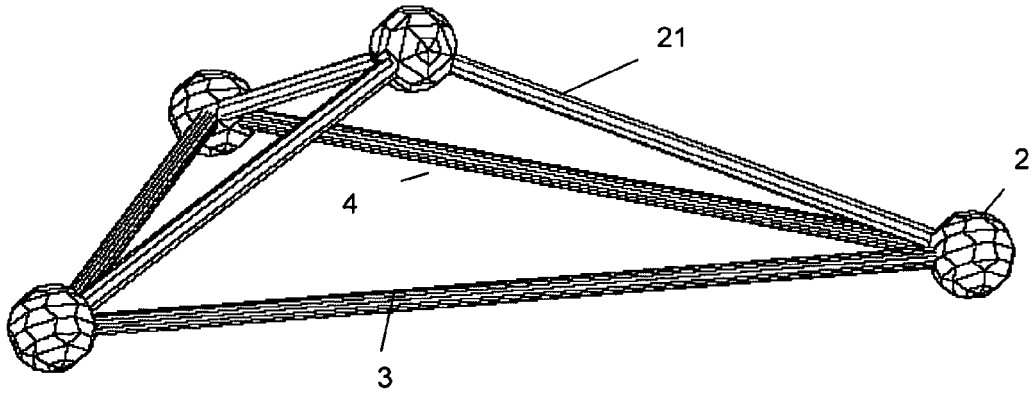
Figure 11:
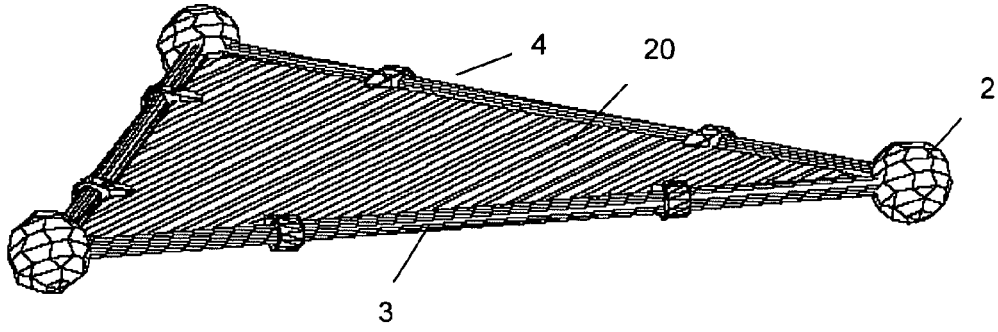

FIG. 1 a perspective representation of a rope game device with two hollow ball modules arranged within one another, FIG. 2 a perspective representation of a rope game device with the viewing direction of the equilateral triangle (triangular) face of the icosahedron, FIG. 3 a representation of the guy ropes or connecting ropes, respectively, and of the pentagon ropes, FIG. 4 a perspective representation of a rope game device with one hollow ball module, FIG. 5 a sectional view of a node point with rope tensioning device, FIG. 6 a view of rope tensioning elements in one node point, FIG. 7 a representation of the rope tensioning elements and rod attachment of a node point, FIG. 8 a perspective detailed representation of a node point with rope lugs and rod lugs, FIG. 9 a detailed representation with two hollow ball modules, FIG. 10 a perspective representation of a pyramidal frame extension of an icosahedron frame and FIG. 11 a perspective representation of an insert in a frame element.

In FIG. 1 a rope game device with two hollow ball modules 11 and 12, arranged one within the other, is shown in the viewing direction of a node point 2. An outer frame 1 is combined from frame elements 4, which consist of equilateral triangles. The node points 2 are the connecting elements for rods 3, forming the frame elements 4. Furthermore, guy ropes 6 of a spatial net are attached at anchoring points 10 of the node points 2.The spatial net consists of a larger hollow ball module 11 and a smaller hollow ball module 12 arranged therein. The two hollow ball modules 11 and 12, arranged within each other, have, respectively, twelve pentagons 8, formed by means of pentagon ropes 5, and, respectively, twenty hexagons 9, which are, respectively, formed by the guy ropes 6 or their connecting ropes 7.

In FIG. 2 the same device is shown with a viewing direction into the frame element 4 formed as an equilateral triangle.

FIG. 3 shows rope positions in a detailed manner in a side view with two hollow ball modules 11 and 12. In this case the guy ropes 6 or the connecting ropes 7, extending these, also form the edges of the hexagons 9, and the pentagons 8, formed by the pentagon ropes 5, are shown. Five of the guy ropes 6 are emphasized, which are connected to the emphasized pentagons 8.

In the representation of FIG. 4 the rope positions are shown again in a perspective view for rope game devices with one hollow ball module 11.

FIG. 5 shows a node point 2, formed as a spherical hollow body 13. To a wall 17 of the hollow body 13 the rods 3 of the outer frame 1 are attached by threaded bolts. The operation of the threaded bolts is achieved via an opening 19 in the hollow body 13 closable by a lid 15.

FIG. 6 shows a possible variant of the arrangement of rope tensioning elements 18 on the spherical hollow body 13. The guy ropes 6 extended through the wall 17 of the hollow body 13 are tightened by a tightening bolt, which is operable through the opening 19.

In FIG. 7 the arrangement of the attachment of the rods 3 and of the rope tensioning elements 18 on or in the wall 17 of the spherical hollow body 13 is, respectively, shown exemplary.

FIG. 8 shows in a detailed representation the lugs of the rods 3 and of the guy ropes 6 at the node point 2.

FIG. 9 shows in a detailed representation the rope construction of a rope game device with two hollow ball modules 11 and 12, which are retained via the connecting ropes 7 and the guy ropes 6 at an anchoring point 10.

In FIG. 10 a frame element 4 is shown, which has a frame extension 21 connected to the node points 2 of the frame element 4. In this exemplary embodiment an additional node point 2 is provided as a tip of a triangular pyramid, which edges are connected as rods 3 to the node points 2 of the icosahedron.

FIG. 11 shows a further embodiment according to the invention, in which the face within the frame element 4, an equilateral triangle, is provided with a face insert 20, especially from a fabric material, metal or plastic.

The embodiments, shown in FIGS. 10 and 11, are especially suitable to give on the one hand playing children more security against falling out and on the other hand to achieve further design possibilities of the game device.

REFERENCE NUMERALS LIST

1 outer frame
2 node point
3 rod
4 frame element
5 pentagon rope
6 guy rope
7 connecting rope
8 pentagon
9 hexagon
10 anchoring point
11 outer hollow ball module
12 inner hollow ball module
13 hollow body
14 threaded bolts
15 lid
16 tightening bolt
17 wall
18 rope tensioning element
19 opening
20 insert
21 frame extension

The invention claimed is:

1. Rope game device with an outer frame and with ropes arranged within the outer frame and forming a spatial net and which are attached in a tensionable manner to specific node points of the outer frame, wherein the outer frame comprises an icosahedron shape wherein edges and corners of the icosahedron shape are formed as frame elements having a shape of an equilateral triangle, rods and the node points wherein within the outer frame one or more hollow ball modules are arranged and retained in a tensionable manner, which are arranged within one another and have the spatial form of a truncated icosahedron.

2. Rope game device according to claim 1, wherein one outer hollow ball module is retained in a tensionable manner by guy ropes at twelve node points of the icosahedron shape.

3. Rope game device according to claim 1, wherein an inner hollow ball module is retained by connecting ropes at an outer hollow ball module.

4. Rope game device according to claim 1, wherein the outer frame has thirty rods of equal length, which ends are connected to the node points.

5. Rope game device according to claim 1, wherein the outer frame has stabilising elements.

6. Rope game device according to claim 1, wherein the hollow ball modules have twelve regular pentagons and twenty regular hexagons.

7. Rope game device according to claim 6, wherein starting from the corners of each pentagon of an outer hollow ball module, respectively, five guy ropes are brought together in a pyramidic manner at the node point and are retained there in a tensionable manner.

8. Rope game device according to claim 1, wherein corners of each pentagon of an outer hollow ball module are, respectively, connected by five connecting ropes to the corners of each pentagon of one or further inner hollow ball modules.

9. Rope game device according to claim 1, wherein the hollow ball modules are is composed of two rope elements of different length and which are shorter for an inner hollow ball modules.

10. Rope game device according to claim 4, wherein the connecting ropes are rigged guy ropes.

11. Rope game device according to claim 1, wherein the node points, connected to each other by rods, are formed as hollow bodies, containing tensioning elements.

12. Rope game device according to claim 1, wherein the rods are retained by threaded bolts on a wall of the hollow body.

13. Rope game device according to claim 1, wherein rope tensioning elements are retained in or at wall of hollow body.

14. Rope game device according to claim 1, wherein one frame element has a frame extension connected to the node point.

15. Rope game device according to claim 1, wherein a frame extension is formed as a spatial construction from rods and node points.

16. Rope game device according to claim 1, wherein at least one equilateral triangle, formed by a frame element, has a two dimensional insert.

17. Rope game device according to claim 16, wherein the two dimensional insert is formed from a fabric material, metal or plastic.

* * * * *